US011447208B2

(12) United States Patent
Sipilä et al.

(10) Patent No.: US 11,447,208 B2
(45) Date of Patent: Sep. 20, 2022

(54) VESSEL WITH A SEMI AUTOMATIC OR AUTOMATIC MOORING SYSTEM AND METHOD

(71) Applicant: Kongsberg Maritime CM AS, Ålesund (NO)

(72) Inventors: Sauli Petteri Sipilä, Turku (FI); Oskar Levander, Parainen (FI); Mark Callaway, Ålesund (NO); Michal Romek, Rauma (FI)

(73) Assignee: Kongsberg Maritime AS

( * ) Notice: Subject to any disclaimer, the term of this patent is extended or adjusted under 35 U.S.C. 154(b) by 0 days.

(21) Appl. No.: 16/962,986

(22) PCT Filed: Jan. 18, 2019

(86) PCT No.: PCT/NO2019/050010
§ 371 (c)(1),
(2) Date: Jul. 17, 2020

(87) PCT Pub. No.: WO2019/143256
PCT Pub. Date: Jul. 25, 2019

(65) Prior Publication Data

US 2020/0354021 A1 Nov. 12, 2020

(30) Foreign Application Priority Data

Jan. 19, 2018 (NO) ..... 20180090

(51) Int. Cl.
*B63B 21/20* (2006.01)
*B63B 21/00* (2006.01)

(52) U.S. Cl.
CPC ..... *B63B 21/20* (2013.01); *B63B 2021/003* (2013.01)

(58) Field of Classification Search
CPC ..... B63B 21/20; B63B 2021/003; B63B 2021/001; B63B 2035/006; B63B 21/16; B63B 21/06; B63B 2021/206; B63B 21/04
(Continued)

(56) References Cited

U.S. PATENT DOCUMENTS 4,729,332 A 3/1988 Ohta et al.

FOREIGN PATENT DOCUMENTS

CN 101356092 A 1/2009
DE 124408 7/1967
(Continued)

OTHER PUBLICATIONS

International Search Report for PCT/NO2019/050010 dated May 22, 2019 (4 pages).
(Continued)

*Primary Examiner* — Anthony D Wiest
(74) *Attorney, Agent, or Firm* — Conley Rose, P.C.

(57) ABSTRACT

Disclosed is a vessel with a semi automatic or automatic vessel mooring system and a method of mooring with such a system. The vessel includes a hull, a mooring line winch unit, at least one mooring line extending from said winch unit, and a weight at an end of the at least one mooring line. A mooring line guide boom with at least one mooring line guide on a mooring line guide portion is movable between a retracted position aligned with the hull, and an extended position. In the extended position the mooring line guide boom allows the winch unit to lower the weight at the end of the mooring line extending through the mooring line guide and onto a quay.

16 Claims, 8 Drawing Sheets

(58) Field of Classification Search
USPC ..... 114/230.25
See application file for complete search history.

(56) References Cited

FOREIGN PATENT DOCUMENTS

| | | | |
|---|---|---|---|
| DE | 1244008 | B | 7/1967 |
| JP | S56116586 | | 9/1981 |
| JP | S56116586 | A | 9/1981 |
| JP | S6194887 | | 5/1986 |
| JP | S6194887 | A | 5/1986 |
| JP | H06099881 | A | 4/1994 |
| KR | 10-2013-0134838 | A | 12/2013 |
| RU | 2013287 | C1 * | 5/1994 |
| RU | 2013287 | C1 | 5/1994 |
| SU | 1362680 | A1 | 12/1987 |
| WO | 2017/167877 | A | 10/2017 |

OTHER PUBLICATIONS

Written Opinion for PCT/NO2019/050010 dated May 22, 2019 (5 pages).
International Preliminary Report on Patentability for PCT/NO2019/050010 dated Apr. 17, 2020 (14 pages).
English translation of abstract to Japanese patent No. S6194887.
English translation of abstract to Japanese patent No. S561165.
Chinese First Office Action dated Jan. 29, 2022, for CN Patent Application No. 201980008921.3.
IPOS Search Report and Written Opinion dated Sep. 29, 2021, for Application No. SG 1202006586Q (8 pg.).

* cited by examiner

VESSEL WITH A SEMI AUTOMATIC OR AUTOMATIC MOORING SYSTEM AND METHOD

CROSS REFERENCE TO RELATED APPLICATION

This application is a 35 U.S.C. § 371 national stage application of PCT/NO2019/050010 filed Jan. 18, 2019 and entitled "A vessel with a semi automatic or automatic mooring system and method," which claims priority to Norwegian Application No. 20180090 filed Jan. 19, 2018, each of which is incorporated herein by reference in their entirety for all purposes.

STATEMENT REGARDING FEDERALLY SPONSORED RESEARCH OR DEVELOPMENT

Not applicable.

FIELD OF DISCLOSURE

The present disclosure relates to a vessel with a semi automatic or automatic vessel mooring system and a method for docking with such a system. The vessel is typically an autonomous vessel, but it can also be a manned vessel. Docking of autonomous vessels is best performed without any personnel on board the vessel. The present disclosure provides a system that automatically presents the mooring lines onto a quay, without requiring any special equipment or adaptions of the quay. The quay should however include a crew to attach the mooring lines onto bollards or other suitable attachment structures.

BACKGROUND OF THE DISCLOSURE

Prior art solutions include solutions with various types of arms or booms for holding a vessel to a quay. The arms are typically manually operated. Most of these solutions do however require the quay to be adapted to the vessel in one way or another. Other types include arms that form a part of the mooring after the mooring is completed.

SUMMARY OF THE DISCLOSURE

In the present disclosure, the arm is operated automatically, and the arm does not form a part of the mooring after the mooring is completed. Furthermore many manual operations or interventions with the system can be performed from the quay.

The present disclosure provides at least a semi-automatic system that can be used on quays that not is particularly adapted for the mooring system.

Furthermore, the disclosed systems do not require any particularly adapted control system on the quay, and does not require any manual operation on-board the unmanned vessel.

Furthermore, the system can be kept completely away from the top deck area of the vessel, reserving the area for other purposes.

Furthermore, the system can be used in connection with more than one mooring line, enabling the system to be used for breast lines, spring lines, bow lines, stern lines etc.

The system also includes a control unit, typically attached onto a weight used as a part of the system.

The present disclosure relates to a vessel with a semi automatic or automatic vessel mooring system. The vessel includes a hull, a mooring line winch unit, and at least one mooring line extending from said winch unit. A weight is secured to an end of the at least one mooring line. A mooring line guide boom with at least one mooring line guide on a mooring line guide portion, is movable between a retracted position aligned with the hull, and an extended position above a quay. The mooring line guide boom in the extended position allows the winch unit to lower the weight at the end of the at least one mooring line, extending through the at least one mooring line guide and onto the quay.

The hull may include hull openings and the at least one mooring line may extend through the hull openings.

The at least one mooring line may include a messenger line and a main mooring line attached to the messenger line. The weight may be attached to the end of the messenger line.

The weight may include a shore side controller, controlling at least the winch unit.

The winch unit may be located inside the hull.

The at least one weight may include a conical seating portion conforming to a seat surrounding a mooring line guide boom opening. When the hull include at least one hull opening, the weight may thus seal the hull opening when the at least one mooring line is in a retracted position, allowing the opening/openings to be located further down on the hull without risking water from waves or sea spray entering the opening/openings.

The weights may include a flat bottom surface.

The mooring line guide boom may be pivotally supported in the hull, and may include a mooring line guide boom actuator provided to swing the mooring line guide boom between a retracted position aligned with the hull and the extended position.

The mooring line guide boom of the semi automatic or automatic vessel mooring system may in an alternative embodiment include telescopic elements provided to linearly shift the mooring line guide boom between the retracted position aligned with the hull and the extended position.

The vessel may further include an indicator light for each mooring line.

The vessel may be an autonomous vessel.

The vessel may include two semi automatic or automatic vessel mooring systems, each including three mooring lines, each mooring line being controlled by the winch unit, wherein the winch unit includes one mooring line drum for each mooring line.

Also disclosed herein is a method of semi automatic or automatic mooring of a vessel with a semi automatic or automatic vessel mooring system. The vessel includes a hull, a mooring line winch unit, at least one mooring line extending from said winch unit, a weight at an end of the at least one mooring line and a mooring line guide boom with at least one mooring line guide. The mooring line guide boom is movable between a retracted position aligned with the hull and an extended position. The method comprise the steps of navigating the vessel to come alongside a quay. The mooring line guide boom is then moved from the retracted position alongside the hull to the extended position above the quay. The winch unit is actuated to lower the weights onto the quay. The mooring line guide boom is moved from the extended position above the quay to the retracted position alongside the hull. The mooring line is pulled out to receive a mooring line attachment portion of the mooring line, the mooring line attachment portion is attached to a mooring line attachment element on the quay, and the winch unit is operated to adjust mooring line tightening.

In the event the vessel mooring system includes further mooring lines, the method further includes repeating the steps of pulling the further mooring lines out to receive the further mooring lines attachment portions of the further mooring lines.

The further mooring line attachment portions are attached to further mooring line attachment elements on the quay, and the winch unit is operated to adjust the tightening of the further mooring lines.

The step of operating the winch unit to adjust mooring line tightening includes operating a shore side controller attached to the at least one weight.

The on-board mooring line winch or winches do not have to be traditional drum winches, but can be an automatically fed capstan winch that also can be used in combination with more than one mooring line. Furthermore, the winch unit may also include a grip and release type wire winch that may be used for more than one mooring line.

DETAILED DESCRIPTION OF THE DISCLOSED EXEMPLARY EMBODIMENTS

FIGS. 1-5 shows a sequence for docking an autonomous vessel without having to board the vessel.

Figure 1:
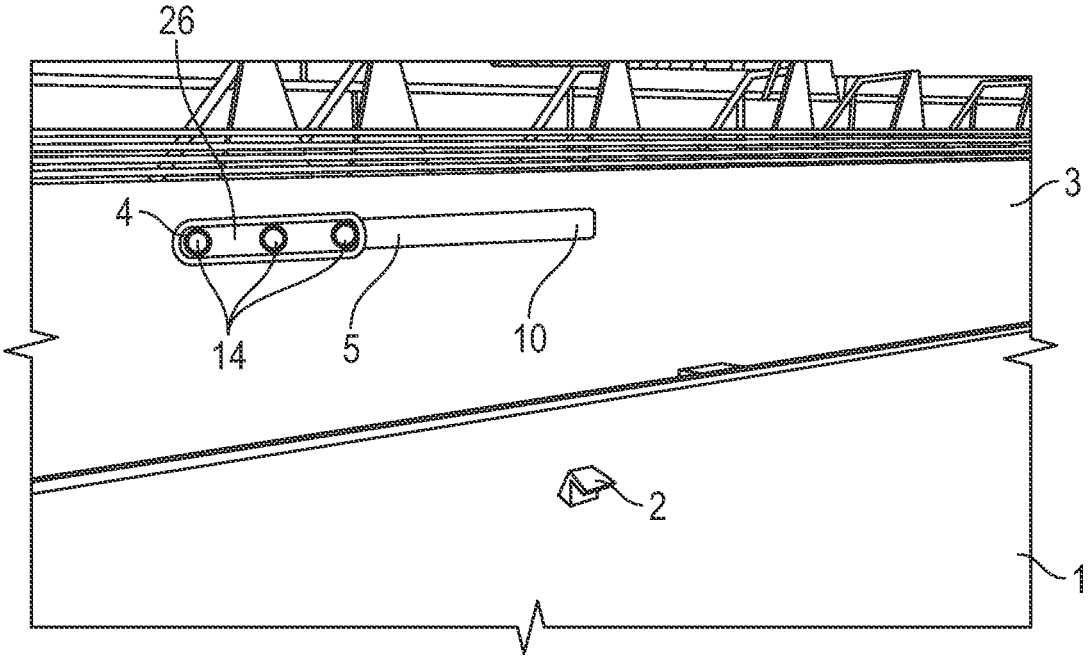
FIG. 1 shows a part of vessel with a mooring system of the disclosure in a first configuration.

In FIG. 1 the vessel 3 is laying along a quay 1. A bollard 2 is secured to the quay 1. The vessel 3 includes a mooring line guide boom 5 provided by a swing arm pivotally supported at a side of a hull of the vessel 3 in a pivot point 10. Three weights 14 with a flat bottom surface 4 are located in and sealing against conical seating surfaces in the mooring line guide boom 5 to prevent sea spray from entering the hull. The flat bottom 4 of the weights 14 and the mooring line guide boom 5, may be flush mounted in the hull to provide a smooth hull side.

The mooring line guide boom 5 includes a mooring line guide portion 26 that in the embodiment of FIGS. 1-6 and 8-10 is constituted by an outer portion of the mooring line guide boom 5 with mooring line guide boom openings.

Winches inside the vessel hold the weights 14 in this seated position.

Figure 2:
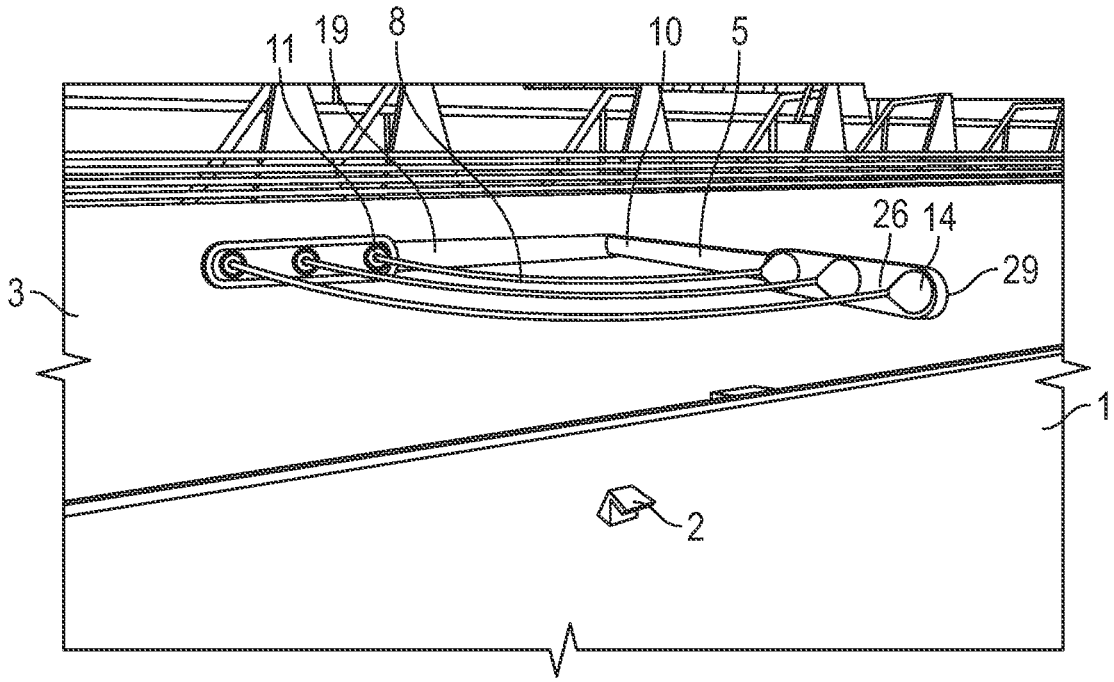
FIG. 2 shows a part of vessel with a mooring system of the disclosure in a second configuration.
Figure 3:
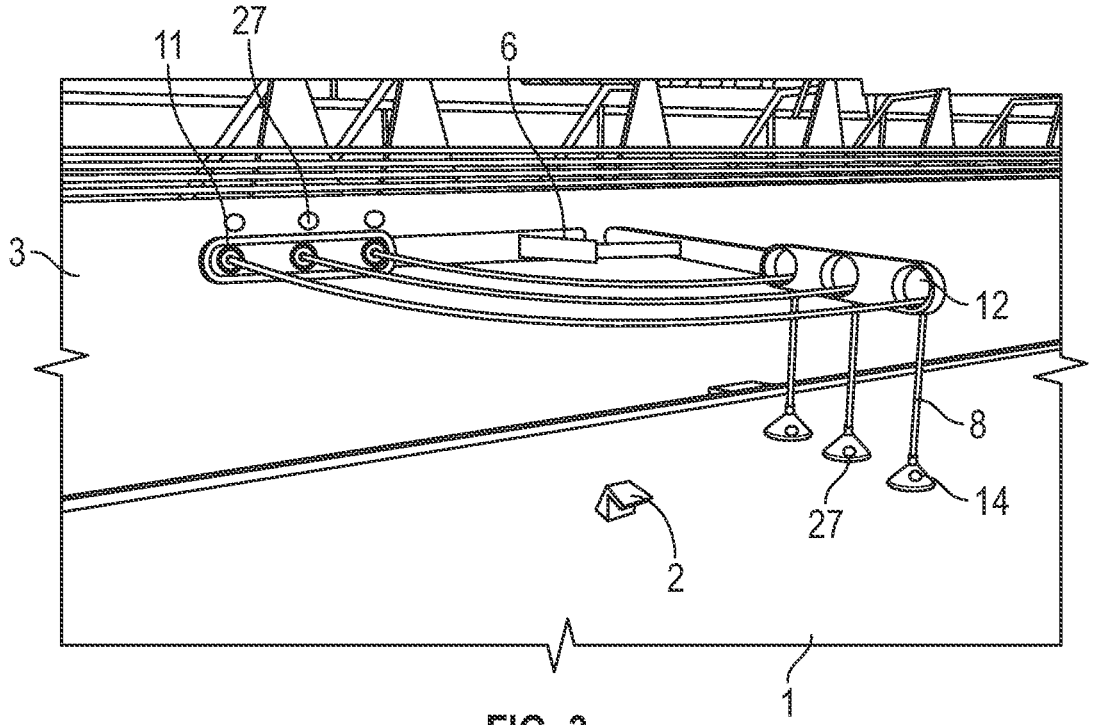
FIG. 3 shows a part of vessel with a mooring system of the disclosure in a third configuration.
Figure 4:
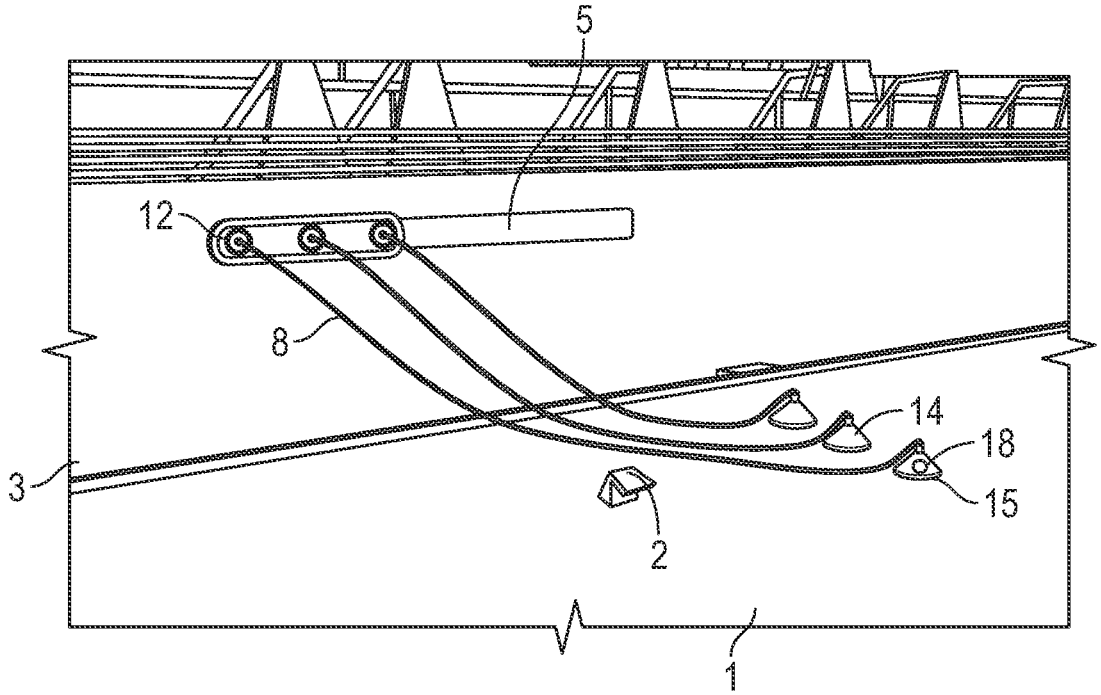
FIG. 4 shows a part of vessel with a mooring system of the disclosure in a fourth configuration.
Figure 5:
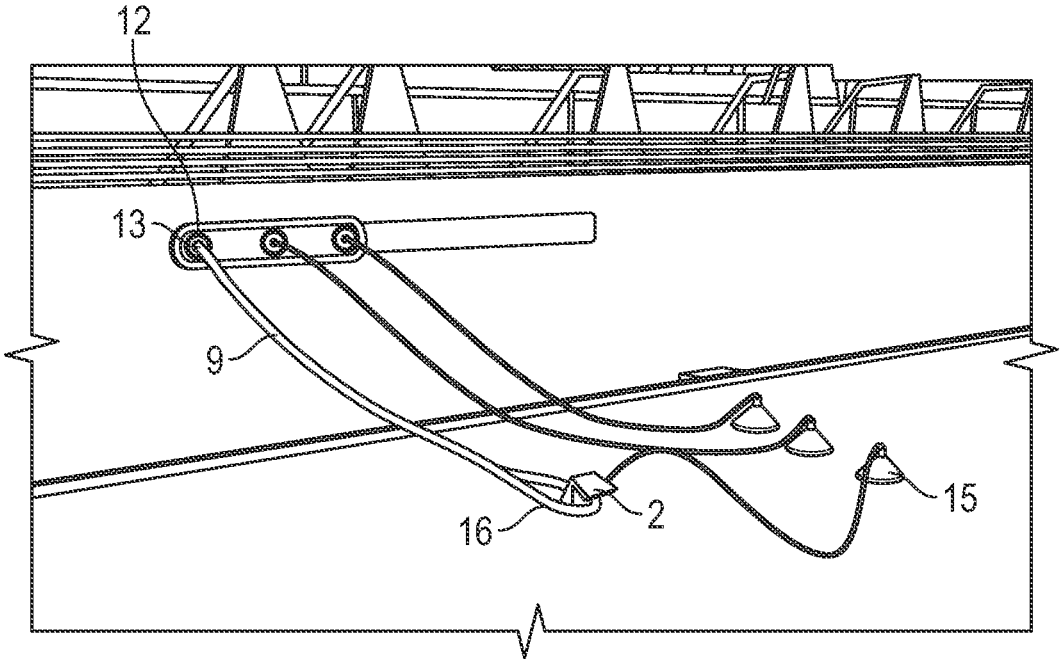
FIG. 5 shows a part of vessel with a mooring system of the disclosure in a fifth configuration.

The sequence includes:

1. FIG. 1, the transit position, the system is inoperative, the weights are substantially flush with the mooring line guide boom and the mooring line guide boom is laying substantially horizontally alongside the hull. The mooring line guide boom may be located in a recess in the hull.
2. FIG. 2, step 1 of the mooring process:
   The mooring line guide boom is swung out and is at an angle from the hull, typically perpendicularly, and is extending substantially horizontally out from the hull. Three messenger lines forming the first part of three mooring lines are let out to allow extension of the mooring line guide boom.
3. FIG. 3, step 2 of the mooring process:
   The mooring lines are let out further to lower the weights onto the quay, while the mooring line guide boom is in the extended position.
4. FIG. 4, step 3 of the mooring process:
   The mooring line guide boom is swung back into the position of FIG. 1 while the weights remain on the quay.
   The mooring line guide boom retracts to a resting position while the mooring line extends through the mooring line guide boom, and the mooring line extends through the mooring line guide boom at all times.
5. FIG. 5, step 4 of the mooring process:
   The one of the messenger lines is pulled to pull out one of the main mooring lines and to secure this main mooring line to the quay. The winch system inside the hull is operated by the shore side controller to tighten this main mooring line. Negligible load is transferred from the mooring lines to the mooring line guide boom.
6. FIG. 5, step 5 of the mooring process:
   Repeat step 4 with the remaining mooring lines as required.

FIG. 2 corresponds to FIG. 1, apart from showing the mooring line guide boom 5 in a position swung out from the hull. A hull recess 19 is located at the side of the hull to accommodate the mooring line guide boom 5, to allow the entire mooring line guide boom 5, including the mooring line guide portion 26 to be flush with the hull when the mooring line guide boom 5 is in a retracted position. The mooring line guide boom 5 is shown in a swung out extended position, pivoted about pivot point 10 at an inner end of the mooring line guide boom 5. The length of the mooring line guide boom must be sufficient to safely extend from the side of the hull to a position above the quay 1. The messenger lines 8 hold the weights 14 seated in the mooring line guide boom openings. The messenger lines 8 extend through hull openings 11 (hawses) and are connected to one or several winches inside the hull. The mooring line guide boom can accordingly be relatively short as long as navigation of the vessel is good. Two three meters or less to an innermost weight should be sufficient. The messenger lines 8 are reeled onto the winches as an extension of main mooring lines, and may be slightly elastic, tightly holding the weights 14 seated in the mooring line guide boom openings. The mooring line guide portion 26 includes a camera 29 that may send real time live images to a controller/harbour master/remotely located control room or may provide information to a computer with pattern matching software.

FIG. 3 corresponds to FIG. 2, apart from showing the weights 14 resting on the quay 1. The messenger lines 8 have been released by the winches inside the hull and are pulled through the mooring line guide boom openings 12/hawses acting as mooring line guides by the weights 14. The mooring line guide boom openings are circular or oval openings with a diameter adapted to allow the widest part of the mooring wire to run through the openings. The widest part of the mooring line is typically the attachment portion part with the mooring line eye 16 (shown on FIG. 5). The diameter of the circular/oval opening can for instance be two times the width of the mooring line attachment portion formed by the mooring line eye. The opening forms a hawse or fairlead for the mooring line and include a rounded edge to reduce wear on the mooring line and on the fairlead. A mooring line guide boom actuator 6 is in an extended position to keep the mooring line guide boom in the position for docking. The hull openings 11 are located outside of the winches and align with the mooring line guide boom openings 12 when the mooring line guide boom is in a retracted position. The flat bottom surface on the weights 14 ensure that the weights are stably located on the quay. The messenger lines 8 are fixed to the weights 14 at their outer end. Indicator lights 27 to indicate a mooring line attachment or release sequence may be located on the weights 14, on the mooring line guide portion or on the vessel 3.

The disclosed embodiment includes three mooring line openings in the hull and in the mooring line guide boom, forming fairleads/hawses for the mooring line.

Alternatively, may the mooring line guide boom openings be dimensioned to allow access to roller fairleads inside the hull. Roller fairleads may also substitute the hawse in the mooring line guide boom.

FIG. 4 corresponds to FIG. 3, apart from showing the mooring line guide boom 5 in a retracted position located in the hull recess. The mooring line guide boom openings 12 are aligned with the hull openings, allowing the messenger lines 8 to run from the winches, through the hull and onto the weights 14 on the quay 1. Pulling the messenger lines 8 will not put any load on the mooring line guide boom 5 in this position. The weights 14 include a conical seating surface 15 for seating against opening seats surrounding the mooring line guide boom openings 12.

A shore side controller 18 is located on one of the weights to control the winches. Communication between the shore side controller, the winches and the mooring line guide boom actuator can run along the messenger lines or can be wireless.

FIG. 5 corresponds with FIG. 4, apart from showing a main mooring line 9 with a main mooring line attachment portion formed by the main mooring line eye 16 attached to the bollard 2. The remaining two messenger lines/pilot lines 8 can be used for extending further main mooring lines for instance for a breast line, spring lines, bow line, stern line etc. The mooring line guide boom opening is surrounded by an opening seat 13 with a shape complementing the shape of the conical seating surface 15 of the weights.

Figure 6:
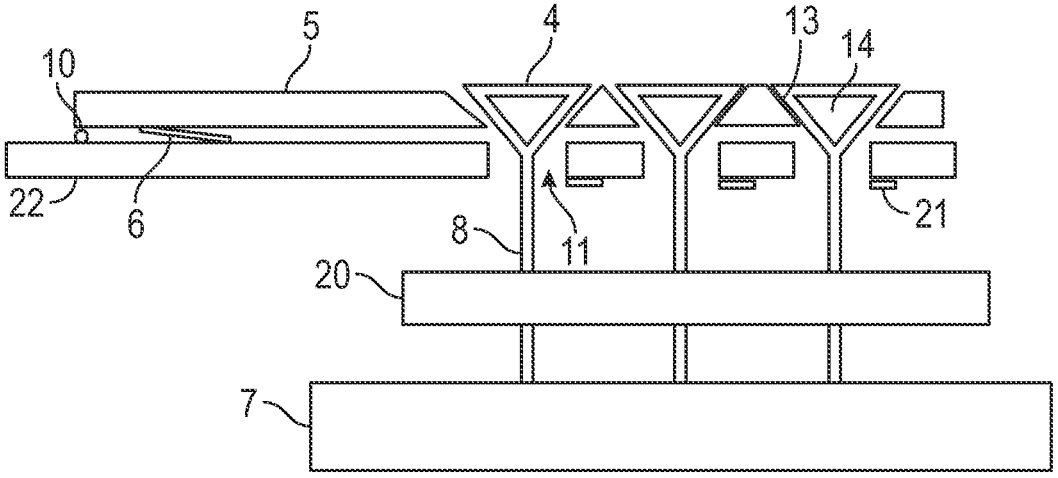
FIG. 6 is a schematic representation of a first embodiment of the disclosure, from above.

FIG. 6 is a schematic representation of a swing out autonomous vessel mooring system. The mooring line guide boom 5 includes openings with opening seats 13 for the weights 14 with flat bottom 4. The openings align with hull openings 11 in the hull 22. An actuator 6 actuates the mooring line guide boom 5 with the mooring line guide portion between an extended position and a position (as shown) in line with the hull 22. The actuator 6 may be an active, dual direction (inn/out) controlled actuator such as a hydraulic cylinder, an electromechanical actuator etc. or a passive spring element. The winch unit may be used to extend or retract the mooring line guide boom 5 when the actuator is a passive spring element. The spring element may include mechanical springs, a hydraulic cylinder and an hydraulic accumulator, gas springs etc. The messenger lines 8 are joined with the main mooring lines (not shown) and extend through a line fixing unit 20 enabling fixing or releasing the lines 8, to a winch unit 7. Line stop detectors 21 provide a signal indicating that the winches should stop when a line is fully retracted and the weight is seated in the opening seat 13. The line fixing unit 20 may be omitted if the winch unit 7 is able to hold the lines under load. The weights 14 seals the hull openings 11 when the weights 14 are in their retracted position shown.

Figure 7:
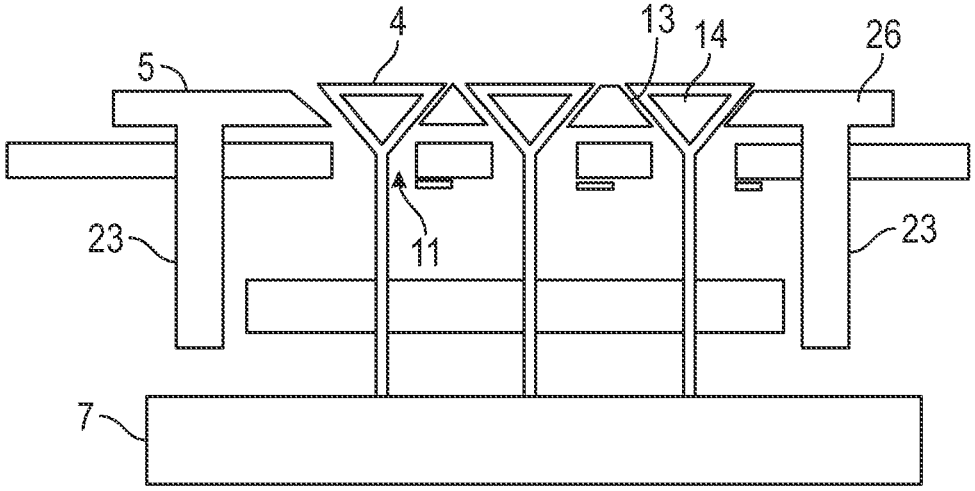
FIG. 7 is a schematic representation of a second embodiment of the disclosure, from above.

FIG. 7 shows an alternative embodiment with linearly extending arms 23 for moving the mooring line guide boom 5 and the mooring line guide portion 26 linearly in or out. In this embodiment, the "mooring line guide boom" is not swinging or pivoting. "Linearly extending arms" is in this context intended to mean and include elements that allow linear displacement of the "mooring line guide portion 26 from a position aligned with the hull at the outside of the hull or in a recess in the hull, and to an extended position located above a quay. The remaining elements correspond to the elements on FIG. 6.

Figure 8:
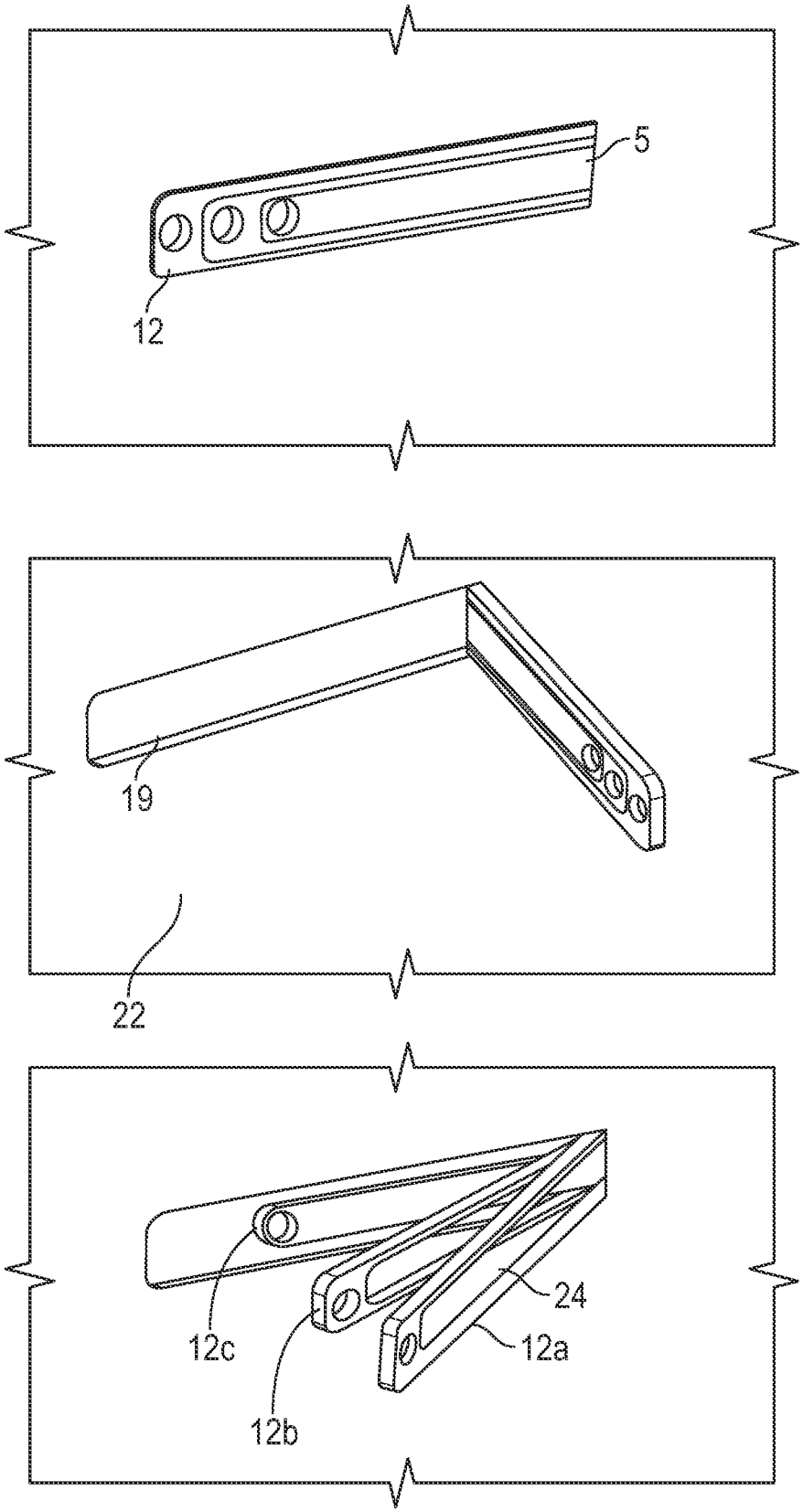
FIG. 8 is a schematic representation of a third embodiment of the disclosure, from the side, showing the mooring line guide boom installed in a hull side.

FIG. 8 shows an embodiment where the mooring line guide boom 5 is divided into three individual mooring line guide boom parts, 12*a*, 12*b* and 12*c*, each carrying a hawse. The three mooring line guide boom parts can be actuated independently with actuators to ease mooring with more than one mooring line. The individual mooring line guide boom parts, 12*a*, 12*b* and 12*c* have a common pivot point and the innermost and shortest mooring line guide boom 12*c* is located in a cut-out 24 in the second innermost and intermediate mooring line guide boom 12*b*, that again is located in a cut-out 24 in the outer and longest mooring line guide boom 12*a*. The mooring line guide booms 12 are located in a recess 19 in the hull 22.

Figures 9A, 9B, 9C, 9D, 9E, 9F:
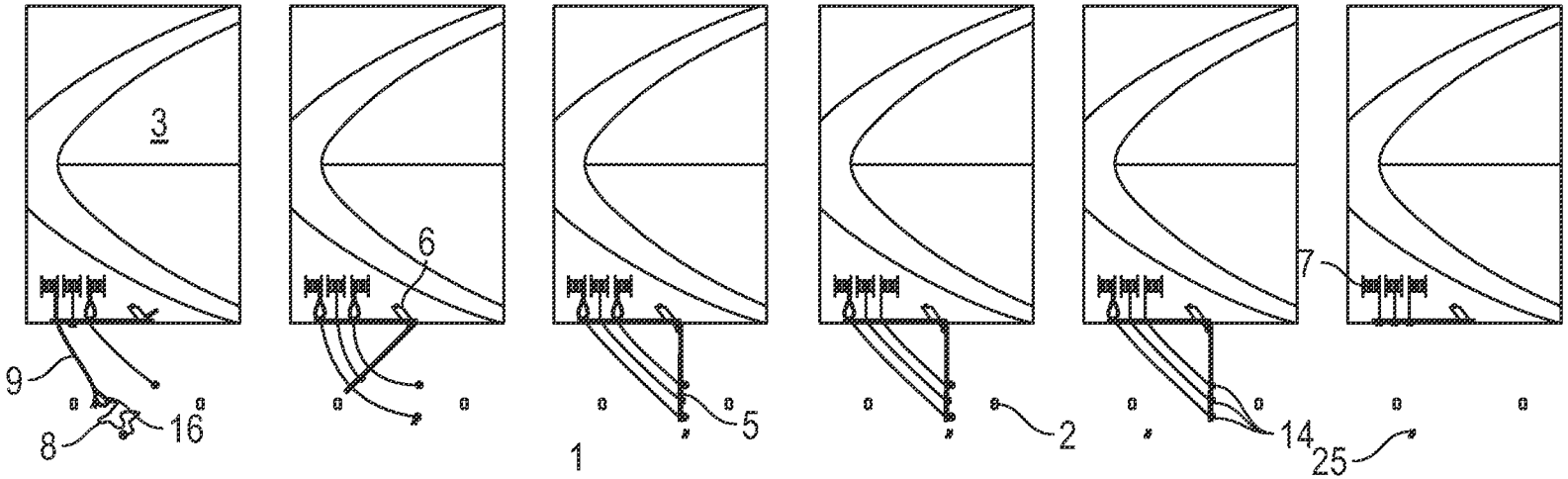
FIG. 9*a*-9*f* is a schematic representation of a sequence for docking with the present disclosure.

FIG. 9 *a-f* shows a sequence during docking. (the same reference numbers apply to all the FIGS. 9*a*-9*f*).

In FIG. 9*a*, the vessel 3 is navigated alongside a quay 1. The semi automatic or automatic vessel mooring system is inactive. See also FIG. 1.

In FIG. 9*b*, the mooring line guide boom 5 is extended by mooring line guide boom actuator 6 and the operation of the winch units 7 are coordinated with the operation of the mooring line guide boom actuator 6 to enable extension of the mooring line guide boom 5 while keeping the weights 14 in their respective positions seated in the mooring line guide boom 5. See also FIG. 2.

In FIG. 9*c*, the left winch unit 7 is operated and the left weight 14 is lowered onto the quay.

In FIG. 9*d*, the right winch unit 7 is operated and the right weight 14 is lowered onto the quay.

In FIG. 9*e*, the mooring line guide boom 5 is retracted by mooring line guide boom actuator 6 and the operation of the centre winch unit 7 is coordinated with the operation of the mooring line guide boom actuator 6 to enable retracting the mooring line guide boom 5 while keeping the centre weight 14 in its respective position seated in the mooring line guide boom 5.

In FIG. 9*f*, a dock labourer 25 has pulled the left messenger line 8 and pulled out the left main mooring line 9, The left main mooring line eye 16 is about to be attached to the left bollard 2. See also FIG. 5 showing the left mooring line eye 16 attached to the bollard 2.

Figures 10A, 10B, 10C, 10D, 10E:
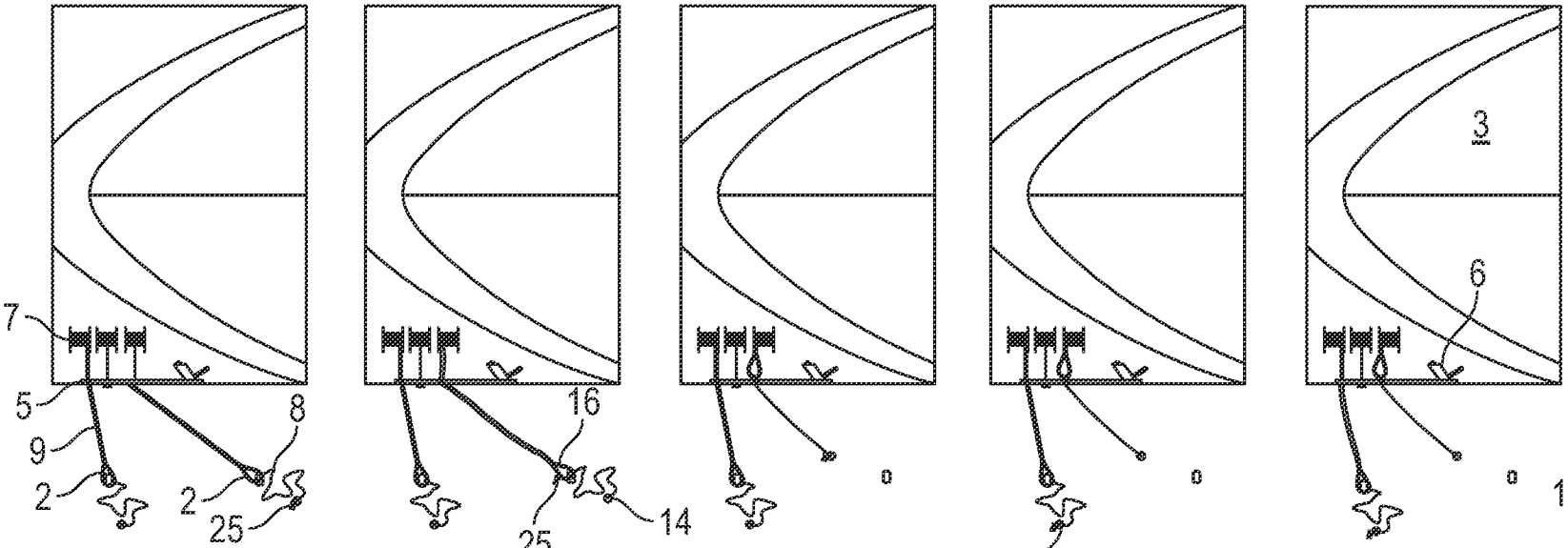
FIG. 10*a*-10*e* is a schematic representation of a sequence for casting off with the present disclosure.

FIG. 10 *a-e* shows a sequence during laying off. (the same reference numbers apply to all the FIGS. 10*a*-10*e*).

In FIG. 10*a*, two main mooring lines 9 are secured to two bollards 2, and the vessel 3 is moored. A dock labourer 25 controls the shore side controller 18 on a weight 14 at the end of a messenger line 8.

In FIG. 10*b*, the dock labourer 25 has released the tension in the right main mooring line and has lifted the main mooring line eye 16 off the bollard 2, thereby releasing the right main mooring line.

In FIG. 10*c*, the dock labourer 25 has operated the right winch unit 7 with the shore side controller 18 and pulled the main mooring line into the vessel 3.

In FIG. 10*d*, the dock labourer 25 is operating the left winch unit 7 with the shore side controller 18 on the weight 14 at the end of the messenger line 8 and releases the tension in the left main mooring line 9.

In FIG. 10*e*, the dock labourer 25 has released the tension in the left main mooring line and has lifted the main mooring line eye 16 off the bollard 2, thereby releasing the left main mooring line.

The shore side controller 18 may include functionality that automatically will run all the winches to their parking position with the weights 14 in their respective resting positions seated in the retracted mooring line guide boom 5.

Figure 11A:
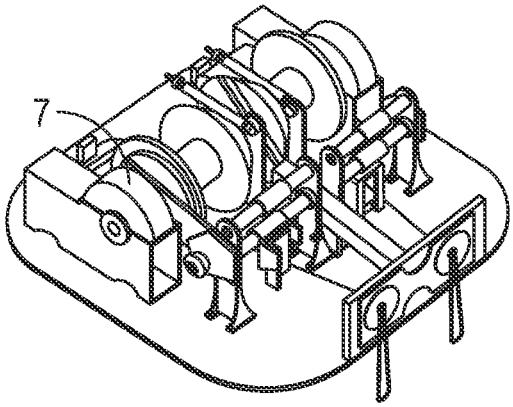
FIGS. 11*a*-11*c*, show a semi automatic or automatic vessel mooring system of a still further embodiment of the disclosure.
Figure 11B:
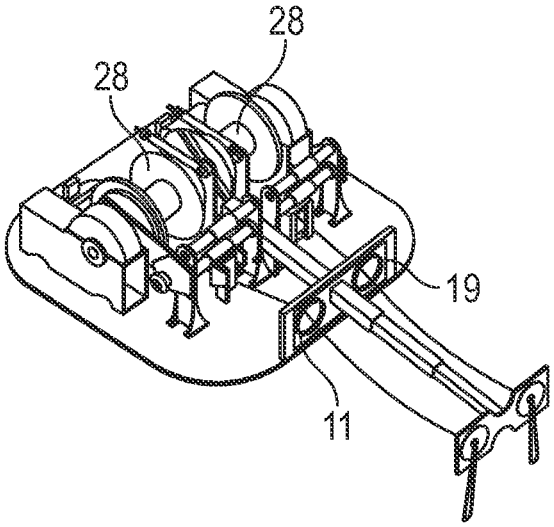
Figure 11C:
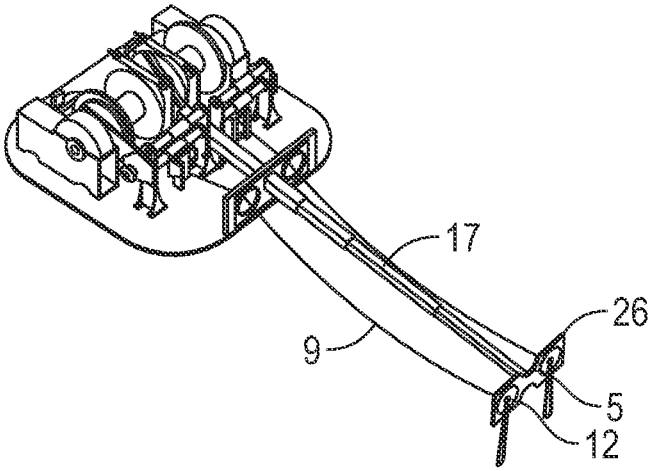

FIGS. 11*a*-11*c* shows the extension of a mooring line guide boom 5 with a mooring line guide portion 26 of an alternative embodiment in which the semi automatic or automatic vessel mooring system includes a single telescopic element or arm 17 and the mooring line guide portion 26 at an outer end of the single telescopic element 17 forming a part of the mooring line guide boom 5. The telescopic element and the mooring line guide portion 26 at the end of the telescopic element forms a T. The mooring line guide boom openings or guides 12 is shown carrying the main mooring lines 9 brought forward by the single telescopic element 17. This is to highlight that in some situations, the messenger lines may be omitted. The single telescopic element may include a passive or active linear actuator to move the mooring line guide boom between the retracted position shown in FIG. 11*a*, the partly extended position shown in FIG. 11*b*, and the fully extended position shown in 11*c*. A passive actuator may include a spring element biasing the mooring line guide boom 5 and the mooring line guide portion 26 towards the extended position. The winch unit 7 may then be used to extend or retract the mooring line guide boom 5. The spring element may include mechanical springs, a hydraulic cylinder and a hydraulic accumulator, gas springs etc. A recess 19 in the hull may have a shape conforming to the shape of the line guide portion 26, allowing the line guide portion to be flush mounted in the hull when the mooring line boom is retracted. The winch unit 7 may include one winch drum 28 for each mooring line and messenger line. The winch drums 28 may be individually operable. The boom openings or guides 12 may include passive or driven rollers to facilitate unreeling of the main mooring lines 9. In this embodiment, the weights are secured directly to the main mooring lines.

The shore side controller could control one or all winches. Alternatively may one shore side controller be a multi function or "smart" controller and several others may be controllers with very basic functions.

As an alternative, the system can be controlled via a remote control station. A camera transferring live pictures can communicate with the remote control station to monitor the operation. The camera can be located on the mooring line guide boom or at another location providing a view of the operation of the mooring with the mooring system, and in particular a view of the main mooring lines and the bollards.

A captain at a remote location, for instance in a control room, can pre-determine which lines to deploy, and a sequence for shore crew to connect the mooring lines.

The system may automatically deploy those messenger lines with weights to a shore crew in specific order, or can simultaneously communicate with the shore side controller indicating which mooring line to do first (could be coloured flashing indicator lights to indicate the sequence).

Shore crew can activate the winch unit to ease line using shore side controller. In this mode, the winch or winches may include tension sensors to identify that a shore crew is trying to pull out the mooring line and the winch unit may assist in unreeling the mooring line.

The shore crew can signal to the shore side controller that a mooring line is secured to bollard and that the mooring line tension can be adjusted. The remotely located captain can predetermine the amount of tension. A computerized control system can substitute the remotely located captain.

The controller can also begin a specific, automatic sequence upon docking, and sensors and detectors can provide signals, initiating the docking process.

The system may be deactivated upon time ashore.

Upon departure, when casting off, the remote captain may reactivate the system to allow release of the mooring lines and winching of the weights into their seats.

The remotely located captain/controller can determine a mooring line release sequence, which is communicated to the shore crew through a de-tensioning sequence and communication from shore side controller. Colored flashing indicator lights on the weights or in connection with each swing-arm opening can indicate which mooring line to be released if a release sequence is required. Shore crew should not remove a mooring line from a bollard before a signal is given. The shore crew remove de-tensioned lines from the bollards and then press a button on the shore side controller to indicate that the weights can be retracted. The weights could be retracted immediately or in a predetermined sequence. The system can be alerted when all mooring lines are successfully retracted.

The system should indicate when failure occurs and provide an emergency signal to the remotely located captain. Failure can include breakage of one or more mooring lines, higher loads than expected, winch failure, transducer failure etc.

A vessel will typically include two semi automatic or automatic vessel mooring systems, one at a bow portion and one at the stern. It should be sufficient to include the system at one side of the vessel only, typically the port side, as long as the vessel can come alongside at this side every time.

The mooring line attachment portion is shown as a mooring line eye. The systems and methods disclosed herein can be used with other types of attachments well known within the field of attaching wires and ropes.

The system can be made totally automatic if the quay is equipped with an automatic attachment system for the mooring lines.

The invention claimed is:

1. A vessel with a semi-automatic or automatic vessel mooring system, the vessel including a hull;

a mooring line winch unit;

at least one mooring line extending from said winch unit;

a weight at an end of the at least one mooring line;

a mooring line guide boom with at least one mooring line guide, and a mooring line guide portion connected to a side shell of the hull and pivotable about a vertically extending axis between a retracted position aligned with and positioned against the side shell of the hull, and an extended position extended from the side shell of the hull;

wherein the hull includes at least one hull opening and wherein the at least one mooring line extends through the at least one hull opening;

wherein the mooring line guide is provided by at least one mooring line guide boom opening in the mooring line guide portion aligned with the at least one hull opening when guide boom is in the retracted position aligned with the hull;

wherein the mooring line guide boom is pivotally supported in the hull, and includes a mooring line guide boom actuator provided to swing the mooring line guide boom with the mooring line guide portion between the retracted position aligned with the hull and the extended position;

whereby the mooring line guide portion in the extended position allows the winch unit to lower the weight at the end of the mooring line extending through the mooring line guide and onto a quay.

2. The vessel of claim 1, wherein the at least one mooring line includes a messenger line and a main mooring line attached to the messenger line and wherein the weight is attached to the end of the messenger line.

3. The vessel of claim 1, wherein the weight includes a shore side controller, controlling at least the winch unit.

4. The vessel of claim 1, wherein the winch unit is located inside the hull.

5. The vessel of claim 1, wherein the at least one weight includes a conical seating portion conforming to an opening seat surrounding a mooring line guide boom opening in the mooring line guide portion, sealing the hull opening when the at least one mooring line is in a retracted position.

6. The vessel of claim 1, wherein the at least one weight include a flat bottom surface.

7. The vessel of claim 1, wherein the mooring line guide boom of the semi automatic or automatic vessel mooring system includes telescopic elements or linearly extending arms provided to linearly shift the mooring line guide portion between a retracted position aligned with the hull and the extended position.

8. The vessel of claim 1, further including an indicator light for each mooring line.

9. The vessel of claim 1, wherein the vessel is an autonomous vessel.

10. The vessel of claim 1, including two or more semi automatic or automatic vessel mooring systems, each vessel mooring system including threat least two mooring lines, each mooring line being controlled by the winch unit, wherein the winch unit includes one mooring line drum for each mooring line.

11. A method of semi-automatic or automatic mooring of a vessel with a semi-automatic or automatic vessel mooring system, the method comprising:

navigating the vessel to come alongside a quay, the vessel comprising:

a mooring line winch unit;

at least one mooring line extending from said winch unit;

a weight at an end of the at least one mooring line; and a mooring line guide boom with at least one mooring line guide on a mooring line guide portion connected to a side shell of a hull of the vessel;

pivoting the mooring line guide portion about a vertically extending axis from a retracted position aligned with and positioned against the side shell of the hull to an extended position extended from the side shell of the hull and above the quay;

actuating the winch unit to lower the weight onto the quay;

moving the mooring line guide portion from the extended position above the quay to the retracted position alongside the hull;

pulling the mooring line out to access a mooring line attachment portion of the mooring line;

attaching the mooring line attachment portion to a mooring line attachment element on the quay; and operating the winch unit to adjust mooring line tightening.

12. The method of claim 11, wherein the vessel mooring system includes a plurality of mooring lines, the method further includes repeating the steps of:

pulling the plurality of mooring lines out to access the attachment portions of the plurality of mooring lines;

attaching the mooring line attachment portions of the plurality of mooring lines to mooring line attachment elements on the quay; and operating the winch unit to adjust the tightening of the plurality of mooring lines.

13. The method of claim 11, wherein operating the winch unit to adjust mooring line tightening includes operating a shore side controller attached to the at least one weight.

14. The method of claim 11, further comprising:

extending the at least one mooring line through a hull opening formed in the hull.

15. The method of claim 11, wherein the mooring line guide is provided by at least one mooring line guide boom opening in the mooring line guide portion aligned with the at least one hull opening when guide boom is in the retracted position aligned with the hull.

16. The method of claim 11, wherein moving the mooring line guide portion from the extended position to the retracted position comprises operating a mooring line guide boom actuator of the mooring line guide boom to swing to swing the mooring line guide boom with the mooring line guide portion from the extended position to the retracted position.

* * * * *